US007683248B2

(12) United States Patent
Rawson

(10) Patent No.: US 7,683,248 B2
(45) Date of Patent: Mar. 23, 2010

(54) PIANO KEY LEVELING DEVICE AND METHOD

(76) Inventor: Christopher Richard Rawson, 351 Cilley Hill Rd., Underhill, VT (US) 05489

( * ) Notice: Subject to any disclaimer, the term of this patent is extended or adjusted under 35 U.S.C. 154(b) by 213 days.

(21) Appl. No.: 11/986,766

(22) Filed: Nov. 26, 2007

(65) Prior Publication Data

US 2008/0121089 A1 May 29, 2008

Related U.S. Application Data

(60) Provisional application No. 60/861,550, filed on Nov. 28, 2006.

(51) Int. Cl.
*G10C 3/12* (2006.01)

(52) U.S. Cl. ..... 84/423 R

(58) Field of Classification Search ..... 84/423 R, 84/430–438

See application file for complete search history.

(56) References Cited

U.S. PATENT DOCUMENTS 373,924 A 11/1887 Church
395,264 A 12/1888 Church
401,309 A 4/1889 Smith
509,915 A 12/1893 Lehr et al.
1,118,939 A 12/1914 Lawrence
1,148,085 A 7/1915 Goble
1,246,998 A 11/1917 Pickard et al
1,403,401 A 1/1922 George
1,592,778 A 7/1926 Perry
1,623,331 A 4/1927 Becker
2,032,745 A 3/1936 Finholm
2,040,304 A 5/1936 George
2,183,916 A * 12/1939 Liaboe ..... 84/432
2,509,063 A 5/1950 Howe
2,550,153 A 4/1951 Ketterman
2,874,601 A 2/1959 Dowling
3,381,576 A 5/1968 Johnson
4,127,051 A 11/1978 Conklin
5,035,168 A 7/1991 Williams et al.
5,654,515 A 8/1997 Youse

* cited by examiner

*Primary Examiner*—Kimberly R Lockett
(74) *Attorney, Agent, or Firm*—James Marc Leas

(57) ABSTRACT

A keyboard musical instrument includes a key, a balance rail, and a key leveling tab. The key leveling tab is permanently mounted on the balance rail. The key leveling tab is non-resonating and has a varying thickness.

26 Claims, 14 Drawing Sheets

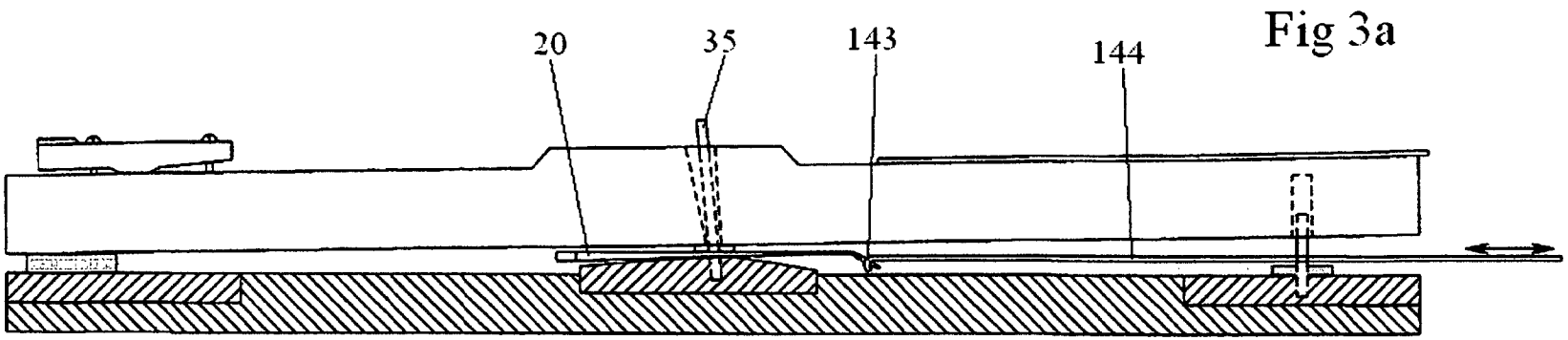
Fig 3a
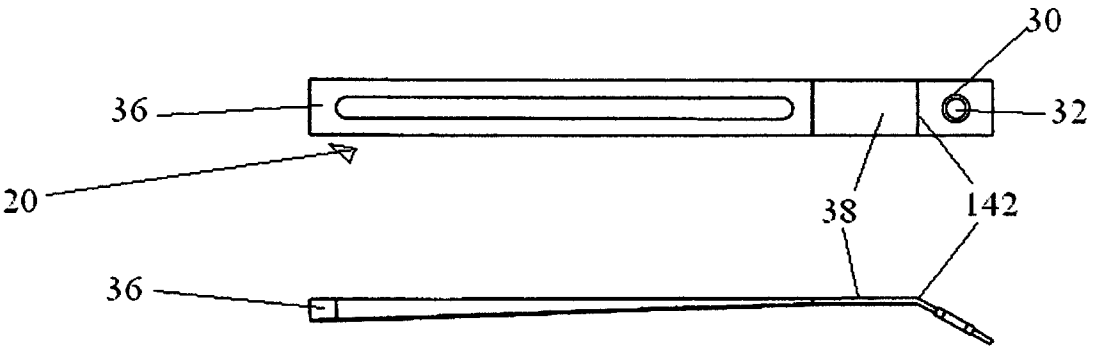
Fig. 2a
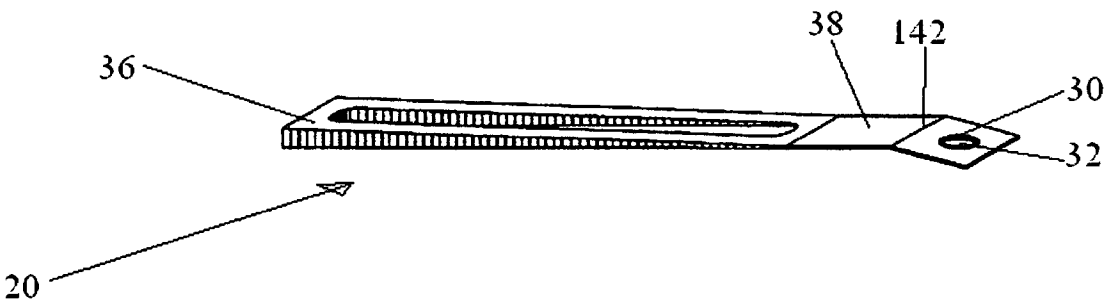
Fig. 2b
Fig. 2c

PIANO KEY LEVELING DEVICE AND METHOD

RELATED APPLICATIONS

This patent application claims the benefit of Provisional Patent Application 60/861,550, filed Nov. 28, 2006 and entitled "Piano Key Leveling Device and Method," incorporated herein by reference.

FIELD

This application generally relates to acoustic key board instruments such as a piano or harpsichord. More particularly, it relates to a scheme for adjusting height of keys of such an instrument.

BACKGROUND

When the 88 keys of a piano, harpsichord, or other keyboard musical instrument, require leveling, a lengthy disassembling process has been required so that a proper-thickness key leveling paper punching could be inserted under each key to compensate for manufacturing margin of error, felt punching compression, and paper punching compression. This process has involved removing the fall board, removing the cheek blocks and key slip from the piano, removing the keyboard musical action—including the key frame and keys—from the cavity behind the fall board (see FIGS. 1*a*,1*b* adapted from *The Piano Book*, by Larry Fine, Brookside Press, Boston, Mass., by permission of Larry Fine), removing the action stack from the key frame, installing clip-on lead weights on the back check at the end of each of the 88 keys, sliding the key frame back into the piano, removing the keys needing adjustment from the key frame, removing the cloth punchings, installing or replacing paper punchings with a proper thickness, and then reassembling. Paper punchings come with at least 8 different thicknesses, and one or more paper punchings that provide a proper thickness are selected to provide leveling for each key to a set height.

The process does not lead to definite results because the clip on weight used may not accurately represent the weight actually imposed by the action. This is because every key has a hammer with a slightly different weight and because the back-rail felt under the back of each key, shown in FIG. 1*b*, is compressible. Thus, other process steps may also be needed to make further adjustments after all these steps are done. This lengthy process has substantially increased the time for assembling a new piano or a new keyboard and for periodic maintenance of an old piano or keyboard, typically needed every two to ten years. This lengthy process has also been a problem for final adjusting high performance pianos before a concert. Thus, a better system is needed to simplify the process of leveling keys and to provide more certain results, and embodiments of such a system are provided in the following description.

SUMMARY

One aspect of the present patent application is a keyboard musical instrument that includes a key, a balance rail, and a key leveling tab. The key leveling tab is permanently mounted on the balance rail. The key leveling tab is non-resonating and has a wedge shape.

Another aspect of the present patent application is a keyboard musical instrument, that includes a key, a balance rail, and a key leveling tab. The key leveling tab is permanently mounted on the balance rail. The key leveling tab is non-resonating and has a slot.

Another aspect of the present patent application is a method of regulating height of a key on a keyboard musical instrument. The method includes providing a musical keyboard instrument having a key, a balance rail, and a wedge shaped key leveling tab. The wedge shaped key leveling tab is mounted on the balance rail. The method also includes providing an external adjusting tool and connecting the external adjusting tool to the key leveling tab. The method then includes using the external adjusting tool to adjust position the key leveling tab on the balance rail to adjust height of the key to a desired height. The method then includes disconnecting the external adjusting tool from the key leveling tab.

BRIEF DESCRIPTION OF THE DRAWINGS

The foregoing will be apparent from the following detailed description as illustrated in the accompanying drawings, for clarity not drawn to scale, in which:

FIG. 2*a* is a top view of one embodiment of the wedge shaped key leveling tab of the present patent application;

FIG. 2*b* is a cross sectional view of wedge shaped key leveling tab of FIG. 2*a;*

FIG. 2*c* is a three dimensional view of the wedge shaped key leveling tab of FIG. 2*a;*

FIG. 3*a* is a cross sectional view of one embodiment of the present patent application illustrating a wedge shaped key leveling tab located between the key and the balance rail of a musical keyboard while it is being adjusted with an adjusting tool;

DETAILED DESCRIPTION

Figure 3B:
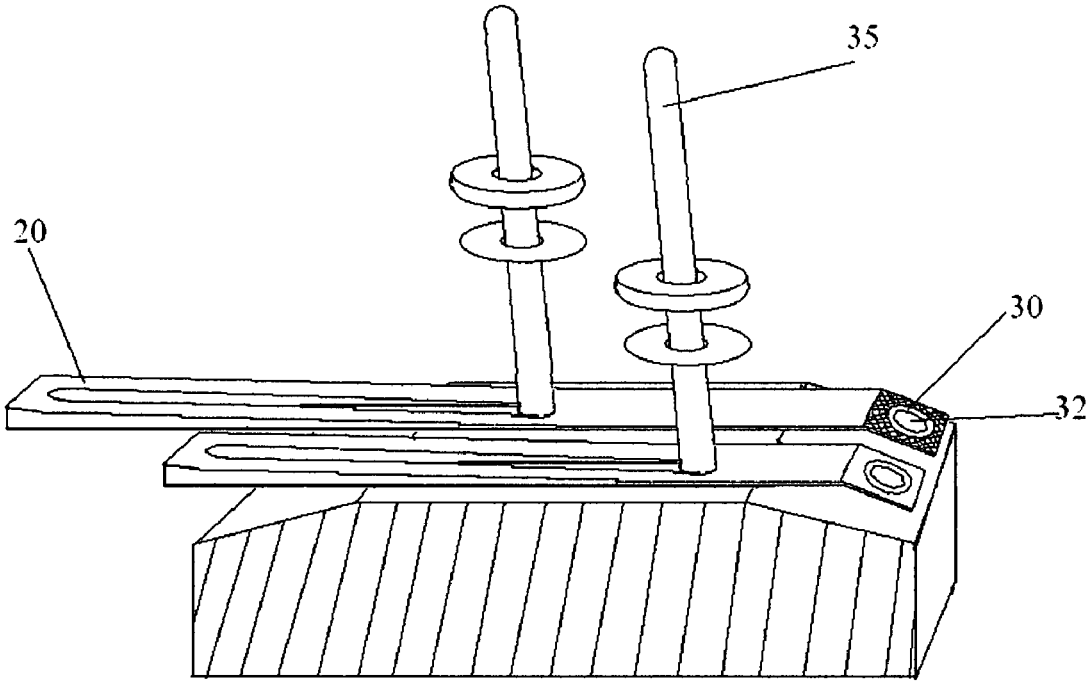
FIG. 3*b* is a three dimensional view of the wedge shaped key leveling tabs for both black and white keys positioned on the balance rail of a musical keyboard.

The present applicant has designed and built a key leveling tab that allows very fast and consistent adjustment of key height for each key of an keyboard musical instrument, without requiring repeated disassembly. The key leveling tab is wedge shaped, as shown in FIG. 2*a*-2*c*, and simply sliding the key leveling tab adjusts the height of the key, as shown in FIGS. 3*a*, 3*b*. The key leveling tab can also be a staircase shape. Once installed, either on a new piano or on an existing piano, key leveling can be provided for all 88 keys in minutes instead of hours. In addition to their use in pianos, similar key leveling tabs can be used for any other musical keyboard that has a balance rail, including harpsichords, fortepianos, and some digital pianos.

Figure 4A:
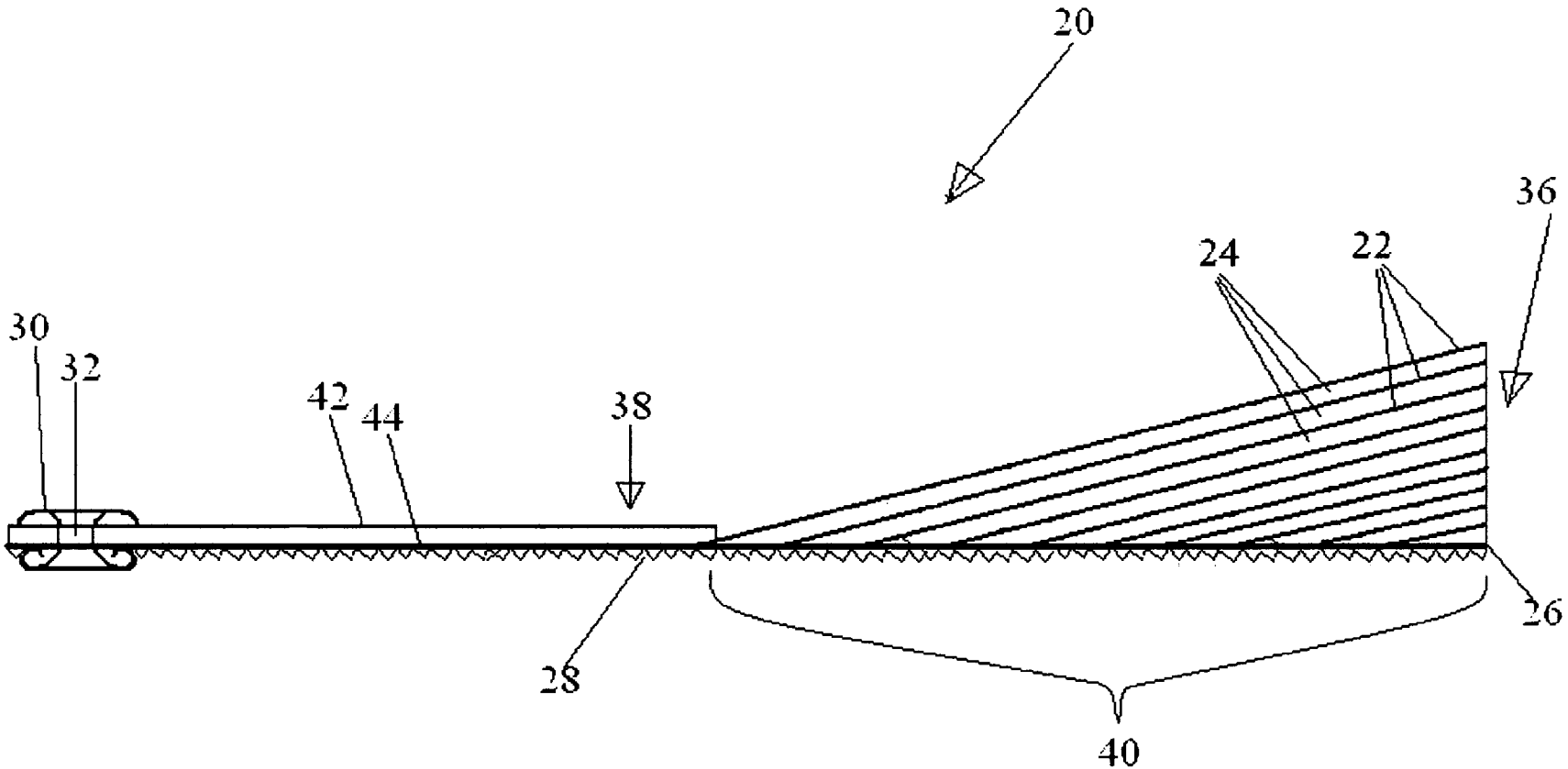
FIG. 4*a* is a cross sectional view of one embodiment of the present patent application illustrating a wedge shaped key leveling tab.

One embodiment of wedge shaped key leveling tab 20 was fabricated with alternating layers of paper 22 and glue 24, mounted on abrasive paper 26 having abrasive surface 28, as shown in FIG. 4*a*. Layers of paper 22 were each about 0.2 mm (8 mils) thick. 400 grit sand paper was used for abrasive paper 26. Wedge shaped key leveling tab 20 has a length of about 4 inches, a width of about ½ inch, and a thickness that varied from about 0.2 mm (8 mils) to about 1.2 mm (48 mils). A grit in the range from 320 to 800 can also be used.

Wedge shaped key leveling tab 20 included grommet 30 surrounding hole 32 that could be used for pulling wedge shaped key leveling tab 20 with hooked tool (see FIG. 2) to adjust position of wedge shaped key leveling tab 20.

Wedge shaped key leveling tab 20 also includes slot 33, as shown in FIGS. 2*a*, 2*c* that enables adjusting location of wedge shaped key leveling tab 20 after it has been mounted on balance rail 34 and around balance pin 35 of a particular key of a piano, as shown in FIGS. 3*a*, 3*b*. Preferably slot 33 extends from near thickest end 36 of wedge shaped key leveling tab 20 to thinnest portion 38 beyond wedge shaped region 40. In one embodiment wedge shaped region 40 extended for about 2 12/inches. In this embodiment slot 33 had a dimension of about 2¾ inches by about 5/16 inch.

Abrasive surface 28 is mounted facing down to retain wedge shaped key leveling tab 20 in position and reduce its chance of sliding out of position after installation and subsequent adjustment. Alternatively, surface 28 can be tacky to accomplish the same purpose. One such wedge shaped key leveling tab 20 is mounted on the balance rail with the respective balance pin extending through slot 33 for each of the 88 keys of a piano.

Reinforcing material 42 can extend on smooth surface 44 of abrasive paper 26 to provide reinforcement for grommet 30. Polyester tape or acid free paper with acrylic adhesive with a combined thickness of 0.038 mm (1.5 mils) can be used for reinforcing material 42.

Figure 4B:
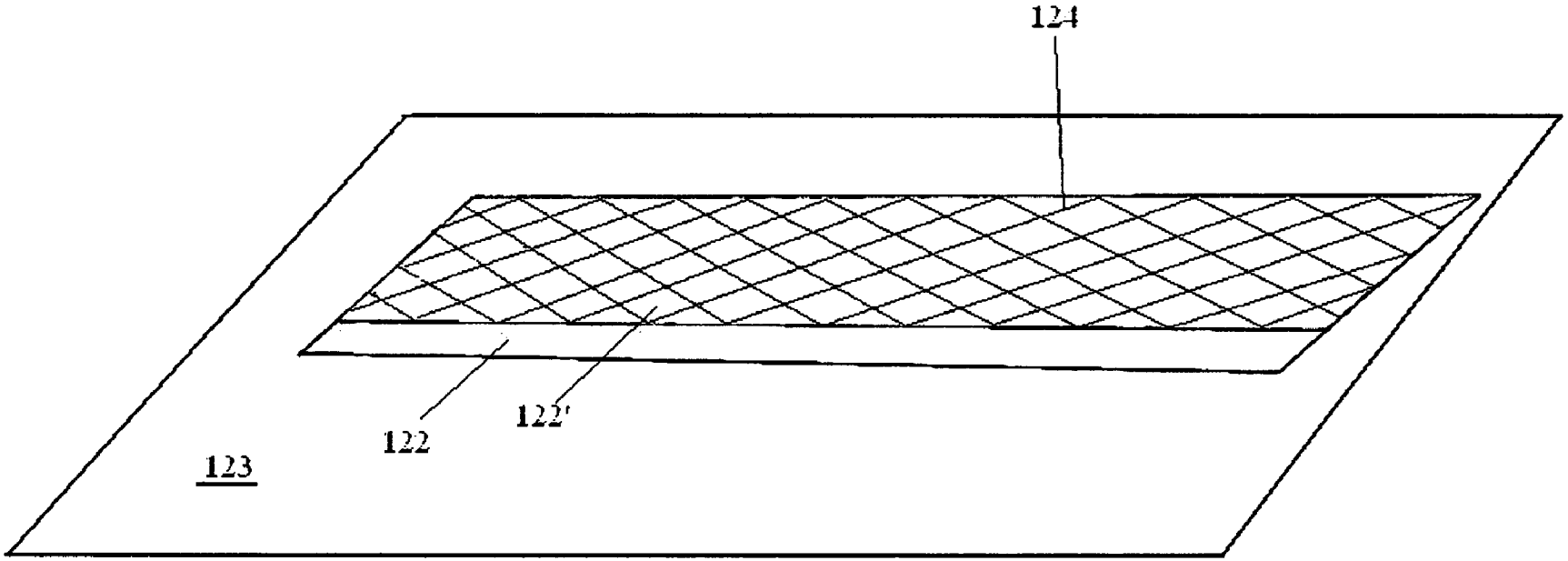
FIGS. 4*b*-4*i* are three dimensional and cross sectional views of one embodiment of steps to fabricate the wedge shaped key leveling tab of FIG. 4*a;*
Figure 4C:
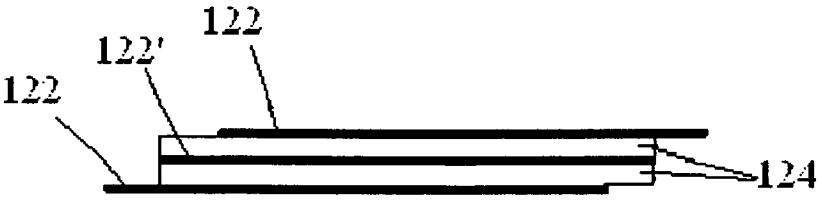
Figure 4C:
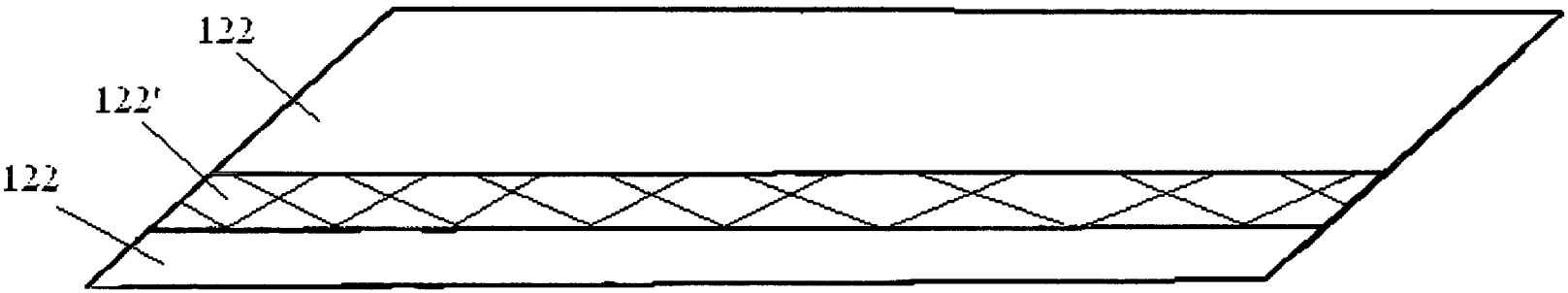

One embodiment of a process for fabricating wedge shaped key leveling tabs 20 is shown in FIGS. 4*b* to 4*i*. Cut strips of desired thickness paper 122 into strips 2⅝ inches wide by 11 inches long, as shown in FIG. 4*b*. Lay out one of the strips 122 on a piece of parchment paper or wax paper 123 on top of a flat surface. When wedge shaped key leveling tabs 20 are complete, this paper 122 will be its top layer.

Take another one of the strips of paper 122, apply paper glue 124 to both sides, and immediately place double glued paper 122' on to plain paper 122, setting double glued paper 122' back about ¼ inch from the edge of plain paper 122, as shown in FIG. 4*b*. Thus, two regions have been formed, one with a thickness equal to that of one glued sheet and one with a thickness of two glued sheets.

Figure 1A:
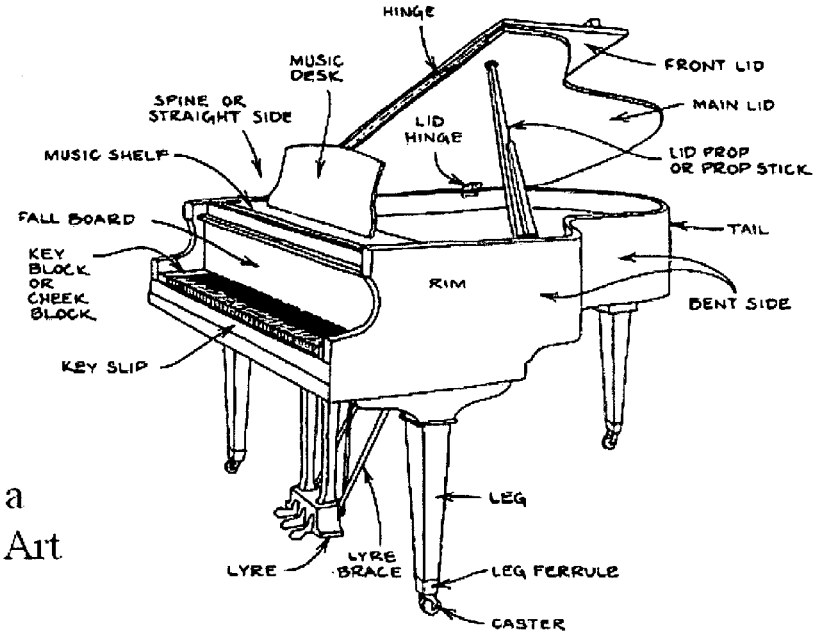
Fig. 1a Prior Art
FIG. 1*a* is a three dimensional view of the cabinet parts of a prior art grand piano.
Figure 1B:
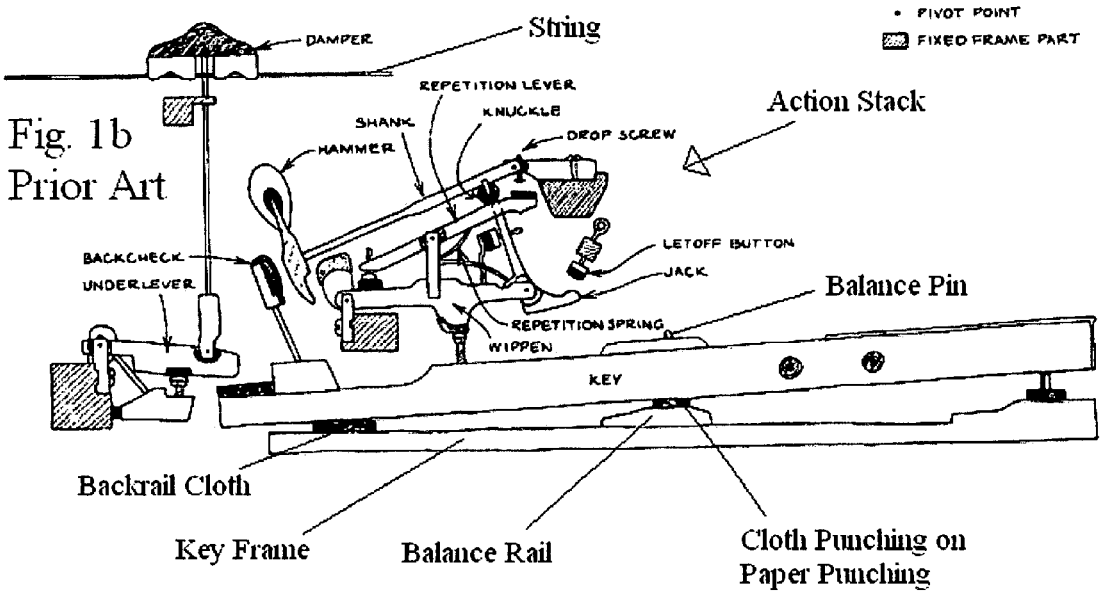
Fig. 1b Prior Art
FIG. 1*b* is a cross sectional view of the prior art action of the prior art grand piano of FIG. 1*a*, including the balance rail, balance pin, and cloth punching on paper punching used for key leveling.

Next, place another one of the strips of plain paper 122 on top of double glued paper 122', setting this strip of plain paper 122 back about ¼ inch from the edge of double glued paper 122', as shown in FIGS. 1*c*, 1*c'*. Thus, three regions have been formed, one with a thickness equal to that of one glued sheet, one with a thickness of two glued sheets, and a third with a thickness of three glued sheets. Continue adding sheets of glued and plain paper until the desired length and thickness of wedge shaped region 40 has been reached.

Figure 4D:
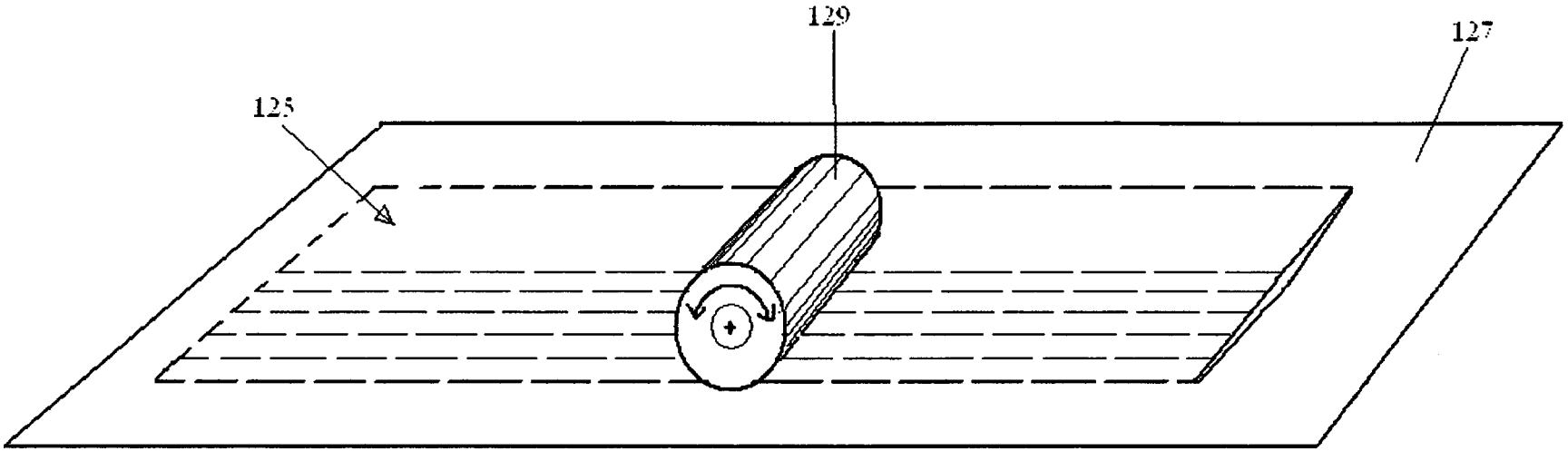

In the next operation, cover the set of glued paper layers 125 with a sheet of parchment paper or wax paper 127 and roll over the wet adhered strips of paper with roller 129, applying pressure to remove any air pockets between strips 122, 122' and to ensure an even thickness and bonding throughout, as shown in FIG. 4*d*.

Figure 4E:
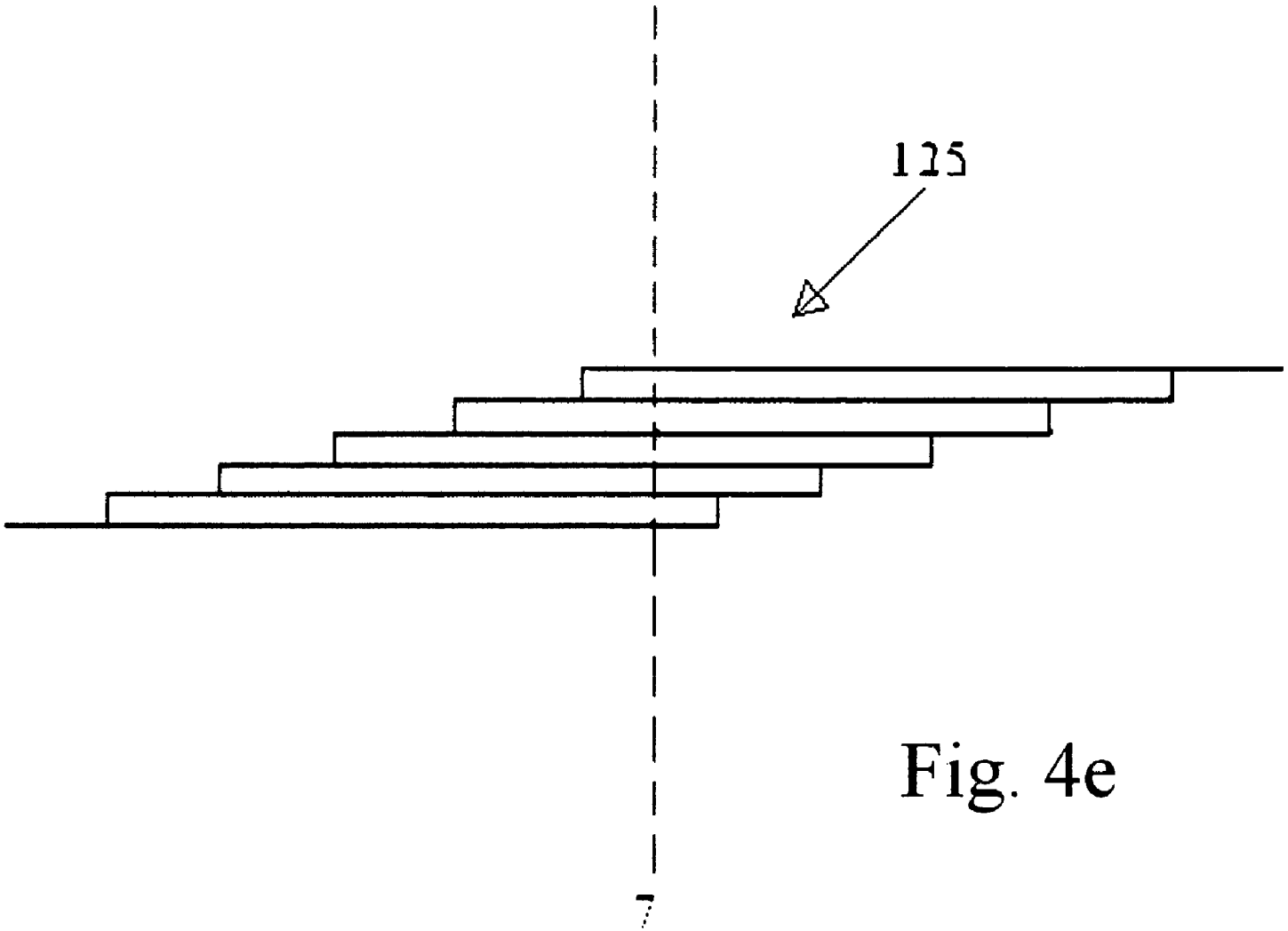

Once glue 124 has dried, cut the set of glued paper layers 125 in half length wise to form 2 wedge shaped strips 131, as shown in side view in FIG. 4*e*.

Figure 4F:
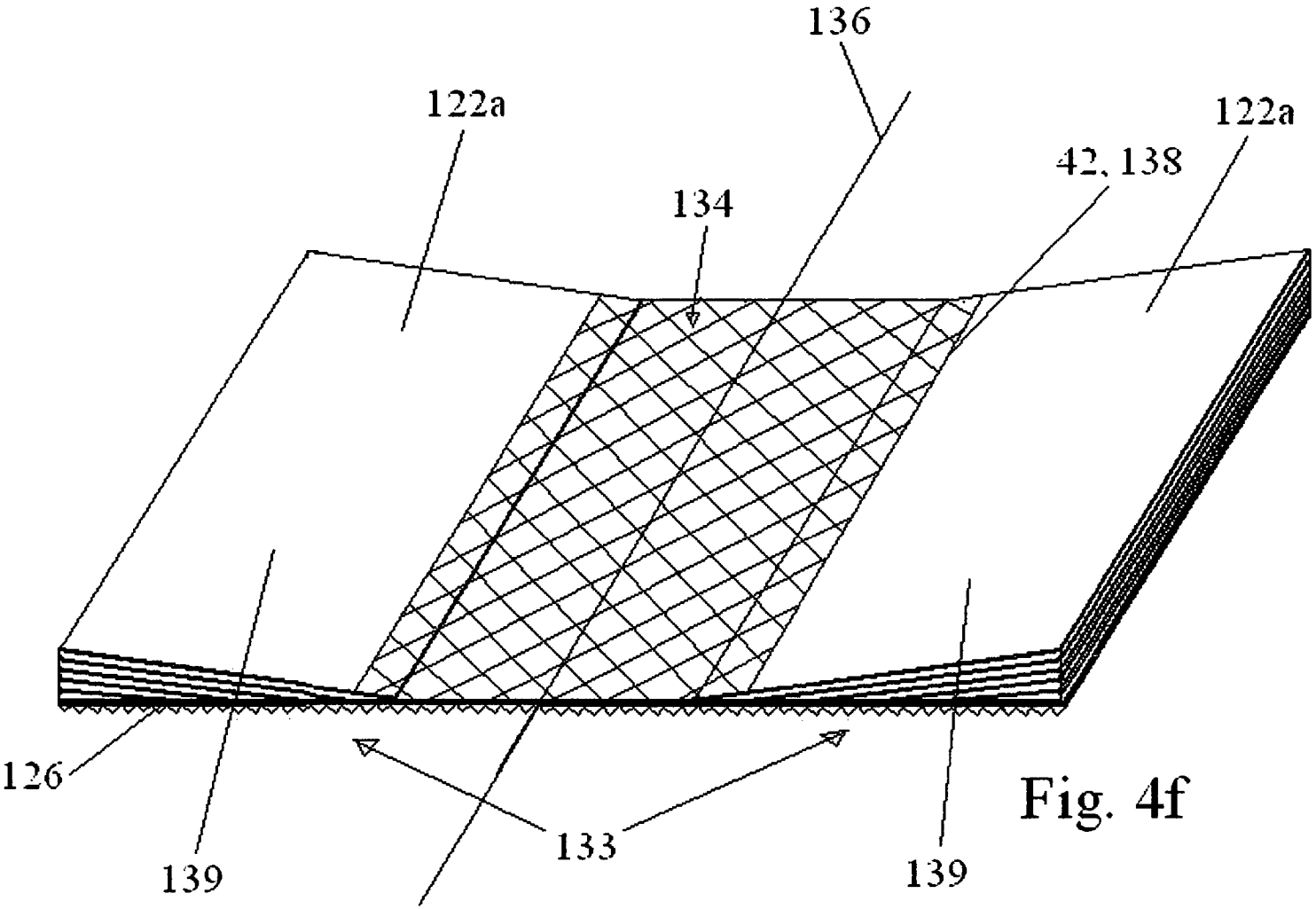

Now glue staircase shaped surface 132 of each of the two wedge strips 131 of glued paper layers to smooth surface 128 of a 9 inch by 11 inch sheet of 400 grit sand paper 126 to form mounted glued paper layers 133, as shown in FIG. 4*f*. Thus, first paper strip 122 is seen on the top surface and sandpaper grit is seen on the bottom surface of mounted glued paper layers 133. Also glue a strip of paper or of polyester edge reinforcing tape 134 down the center, as also shown in FIG. 4*f*. Then cut down along center line 136 to provide a pair of reinforced glued paper layers 139.

Figure 4G:
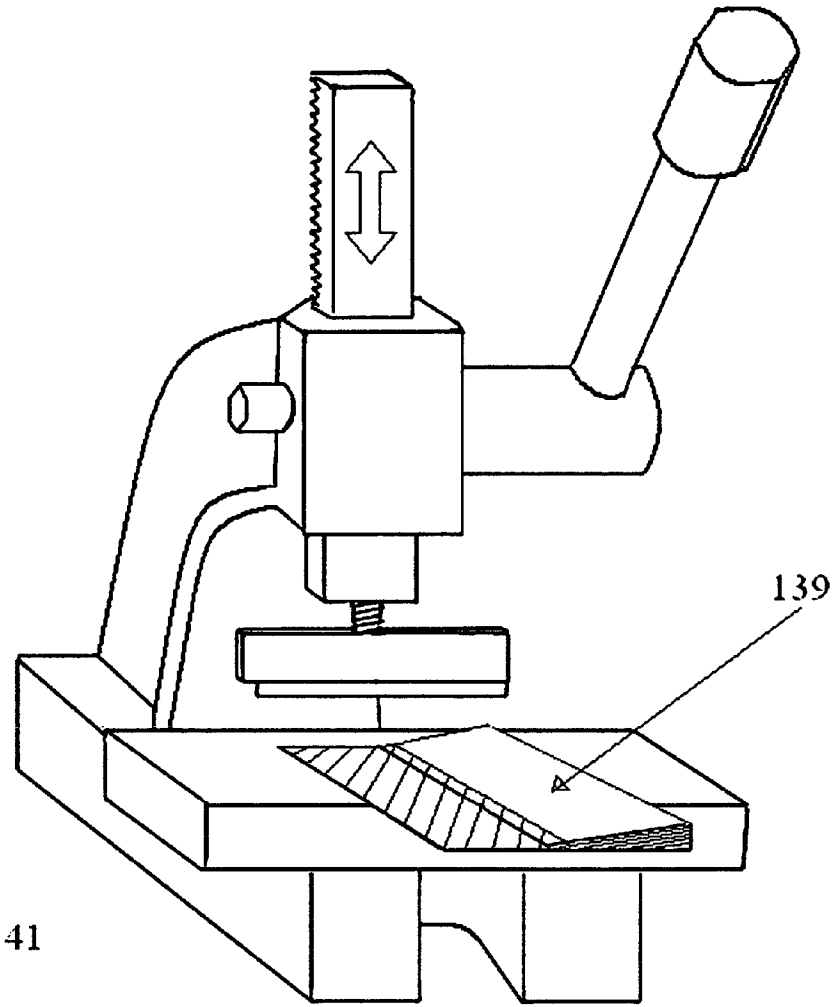
Figure 4G:
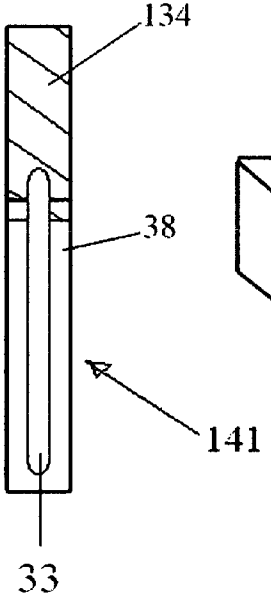

Using arbor press with a hard steel blade, as shown in FIG. 4*g*, simultaneously cut reinforced glued paper layers 139 into half inch wide strips to form slotted wedge strips 141 with slot 33 running down the middle, as shown in FIG. 1*g'*. Slot 33 extends into the thinnest portion 38 of wedge shaped portion key leveling tab 141 where thickness is about equal to that of sandpaper layer 126. Each reinforced glued paper layers makes 21 to 22 of these half inch wide slotted wedge strips 141, as shown in line 9.

Figure 4H:
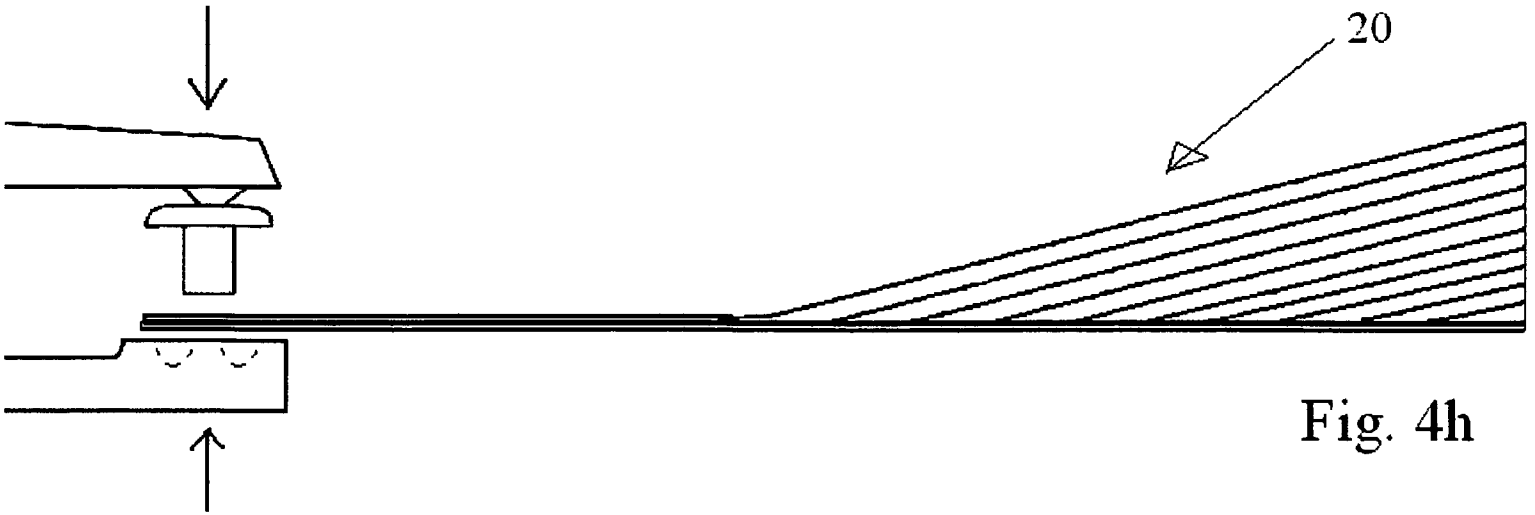
Figure 4I:
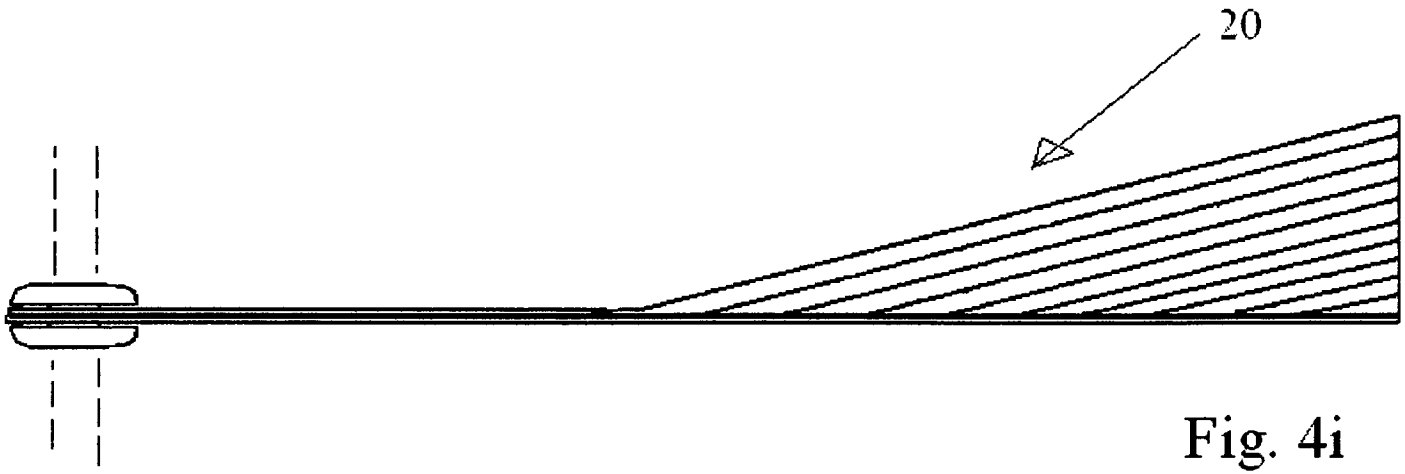

Finally, using grommet inserting pliers, install brass or nickel grommet 30 centered on reinforcement strip 38 as shown in FIG. 4*h* and FIG. 4*i*, to complete forming wedge shaped key leveling tab 20, as shown in FIG. 4*a*. Grommet 30 includes hole 32 that will be used for adjusting position of key leveling tab 20 when it is installed in the musical keyboard.

Wedge shaped key leveling tab 20 can be fabricated of other materials, such as bamboo, wood, wood fiber, fiberglass, or a polymer such as polyester, all of which can be fabricated with dimensions and a wedge shape or a staircase shape similar to that described above. Materials that are non-resonant are preferred so that key leveling tab 20 does not vibrate, producing unwanted sounds. In one embodiment the material is also flexible and sound dampening. In one embodiment it is able to conform to the shape of the balance rail.

While closed slot 33 on key leveling tab 20 maintains both sides of slot 33 in position, an open slot can be used to provide a key leveling tab that can be very quickly installed on a key of a musical instrument. An open slot can be formed simply by cutting off one end of key leveling tab 20. If the open slot is formed by cutting through thinnest portion 38, key leveling tab 20 can be positioned on the balance rail with a long tweezers.

While it is also possible to provide a hole and grommet on each end of wedge shaped key leveling tab 20, the present applicant found that the tab can be pulled or pushed easily using just one grommet 30 and one hole 32. He also found that shiny metal grommet 30 increases the visibility of pulling hole 32 when exposed to a flashlight beam. Alternatively, a paper flag can be provided to better enable locating pulling hole 32 during the adjustment process. End 142 of key leveling tab 20 can be bent down, as shown in FIGS. 2*a*-2*c* and 3*a*-3*b* to also facilitate locating pulling hole 32.

Key leveling tab 20 is installed using the same disassembly and assembly process as used for installing standard balance punchings, except several steps can be eliminated, including providing weights on each key. Follow up process steps for final adjusting can also be eliminated.

Figure 5:
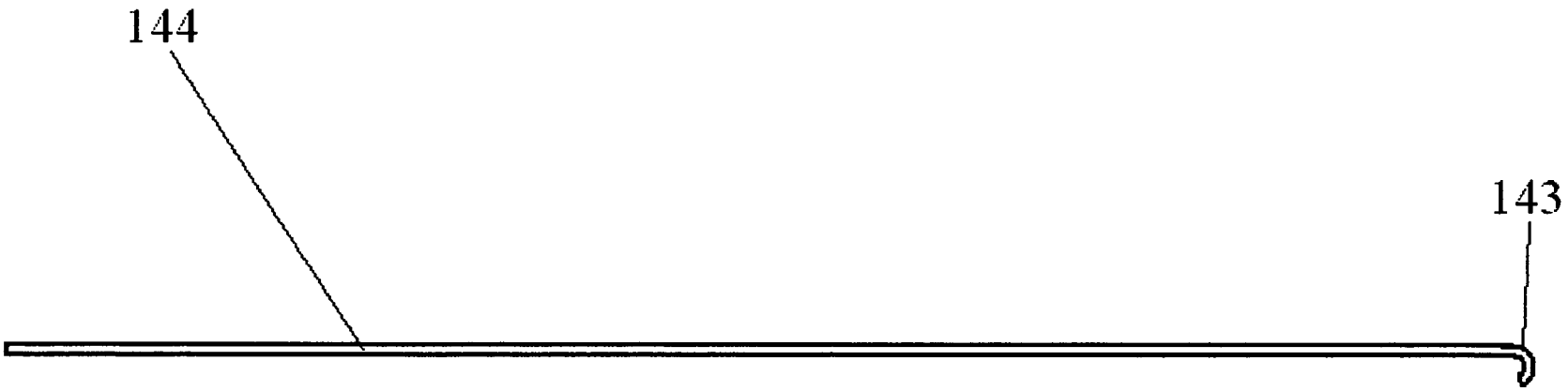
FIG. 5 is a side view of an adjusting tool having a hook that fits through the hole in the grommet of the key leveling tab for adjusting its position.
Figure 6A:
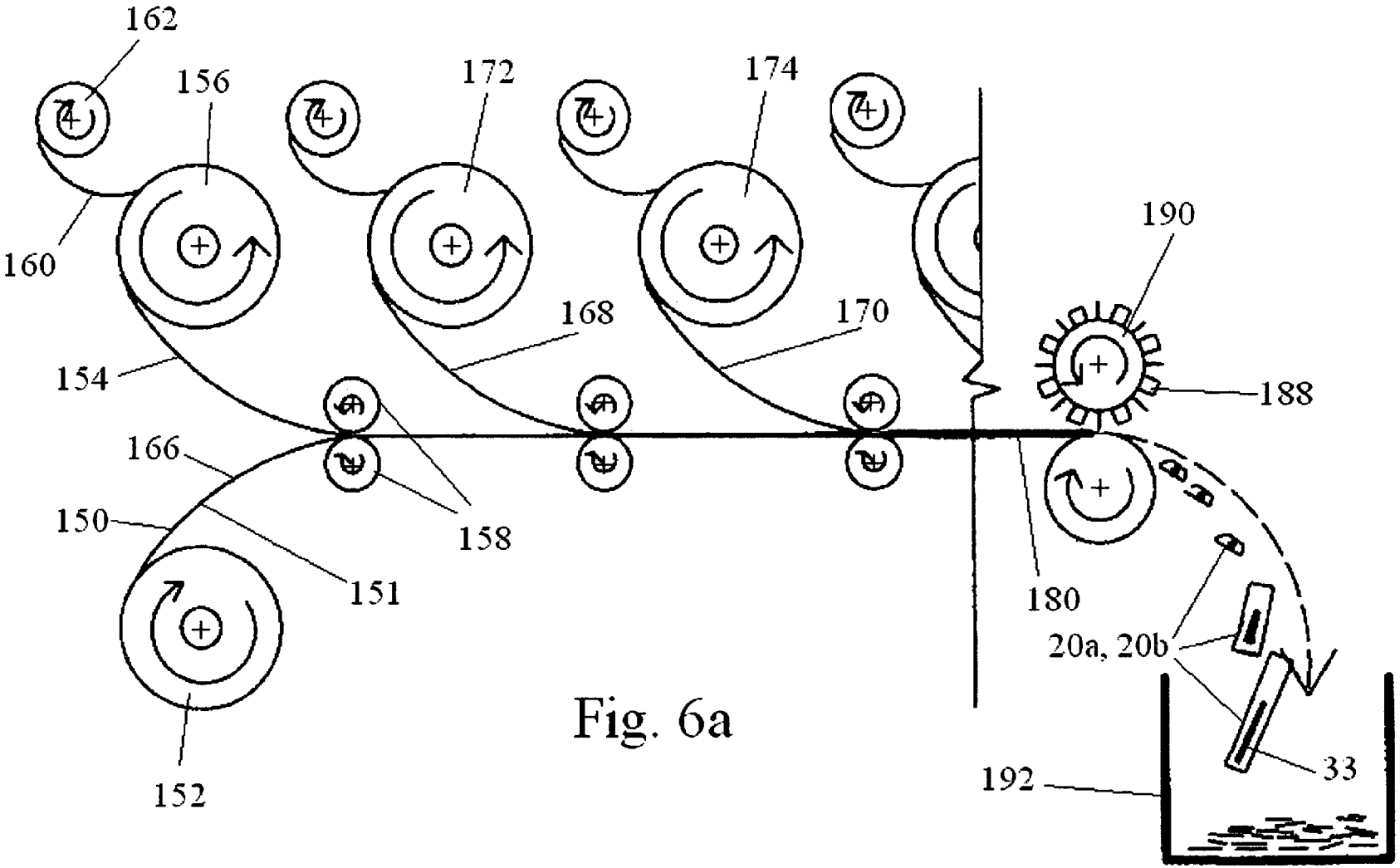
FIGS. 6*a*-6*b* are cross sectional and top views, respectively of an embodiment of a machine that was fabricated to automate the steps for fabricating the wedge shaped key leveling tabs of FIG. 2*a*-2*c*.
Figure 6B:
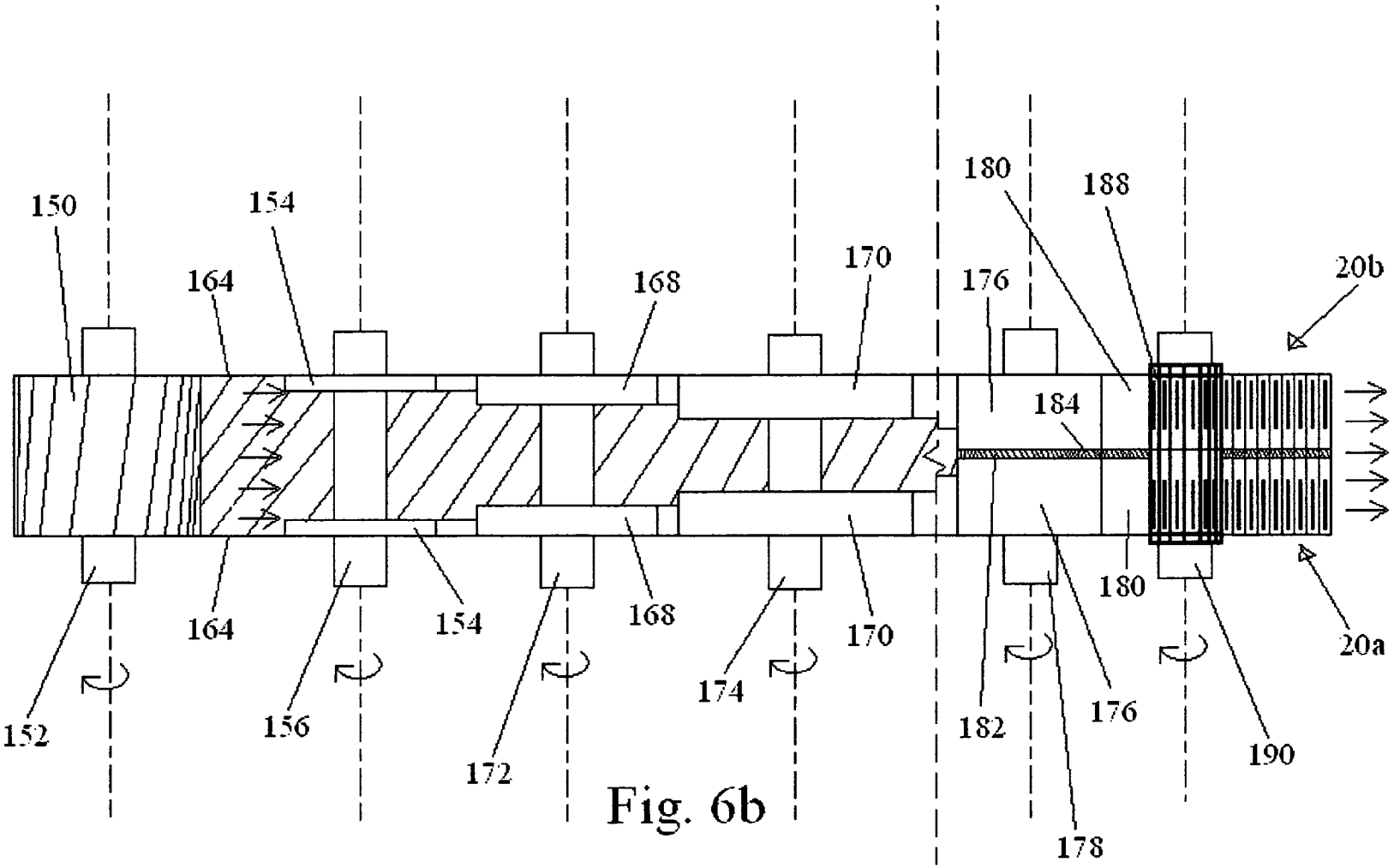

In use, the key slip of the piano is removed. Then the end keys are each supported with a support block (not shown) to the desired height. A straight edge is mounted across all the keys supported on these end keys. Then hook 143 of a key leveling tab adjusting tool 144, similar to a crochet hook, as shown in FIGS. 3*a* and 5, is inserted from underneath the front of the keys into hole 32 in grommet 30 of key leveling tab 20, and key leveling tab 20 is pulled until the front portion of the key rises to the desired height because of the wedge shape of key leveling tab 20. Then the operation is repeated for the next key and the next until all 86 remaining keys have been leveled to the height set by the straight edge resting on the two end keys. Then the straight edge is removed, the blocks are removed, and the key slip is reinstalled.

Another embodiment of a process for fabricating the key leveling tabs is provided by a machine that has been built and is currently in use for this purpose, as shown in FIGS. 4*a*-4*b*.

Sandpaper 150 with grit side 151 down, wound on roller 152, and two strips of narrowest self-adhesive papers 154, both wound on roller 156, are all fed into compression rollers 158, while non-stick backings 160 of narrowest self-adhesive papers 154 are removed and wound onto spool 162. The adhesive surface of both strips of narrowest self-adhesive papers 154 are thereby bonded onto the outermost sides 164 of non-grit side 166 of sandpaper 150. This process is repeated with pairs of progressively wider and wider self-adhesive papers 168, 170, wound respectively on rollers 172, 174, until the last strip of self-adhesive paper 176, mounted on roller 178, and wide enough to extend across both previously bonded stacks of paper layers, has been bonded on top of all previous layers, creating a pair of assemblies of bonded wedge shaped paper layers 180 with their thickest portions at each edge 164. Top strip of paper 176 thus extends over the entire surface of each key leveling tab covering the edge where wedge portion 40 begins, and serving the function of the reinforcing tape of the previously described embodiment. Thus, the thinnest portion of each key leveling tab 20*a*, 20*b* fabricated by this method has a thickness equal to that of sandpaper 150 plus top paper 176.

The wider of these two assemblies includes printed black stripe 182 along what will be its thinnest edge 184 for distinguishing longer key leveling tab 20*a* used for black keys from the shorter key leveling tab 20*b* used for white keys on the piano. Typically tab 20*a* for black keys is about 4¾ inches long while tab 20*b* for white keys is about 4 inches long.

These two bonded wedge shaped paper layers 180 with the common sandpaper 150 bottom layer and the common paper 176 top layer are then both fed into rotary cutting die 188, mounted on roller 190, that separates bonded wedge shaped paper layers 188 into individual key leveling tabs 20*a*, 20*b* and also cuts slots 34 into each individual key leveling tab 20*a*, 20*b*. These individual key leveling tabs 20*a*, 20*b* then fall into collection box 192. Hole 32 and grommet 30 is then provided in key leveling tabs 20*a*, 20*b* as previously described and as illustrated in FIGS. 1*h*, 1*i*.

In another embodiment, key leveling tab 20 is fabricated by molding, extruding, or machining, a polymer, fiberglass, wood, or wood fiber, to form a wedge or staircase shape that includes only a single layer of material.

While the invention has been shown and described in connection with a preferred embodiment, various changes may be made therein without departing from the spirit and scope of the invention as defined in the appended claims.

The invention claimed is:

1. A keyboard musical instrument, comprising a key, a balance rail, and a key leveling tab, wherein said key leveling tab has a first portion having a varying thickness, wherein said key leveling tab is for direct connection with a key leveling tab adjustment mechanism during a key leveling adjustment operation, wherein said key leveling tab is for disconnection from any key leveling tab adjustment mechanism after key leveling adjustment is complete.

2. A keyboard musical instrument, as recited in claim 1, further comprising a balance pin, wherein said key leveling tab includes a slot for accommodating said balance pin.

3. A keyboard musical instrument, as recited in claim 2, wherein said slot is a closed slot.

4. A keyboard musical instrument, as recited in claim 3, wherein said key leveling tab includes a first hole for adjusting position of said key leveling tab with an adjusting tool.

5. A keyboard musical instrument, as recited in claim 4, wherein said first hole includes reinforcing.

6. A keyboard musical instrument, as recited in claim 5, wherein said first hole includes a grommet.

7. A keyboard musical instrument, as recited in claim 4, further comprising a flag extending at an angle to a surface of said key leveling tab for providing visual aid for locating said first hole.

8. A keyboard musical instrument, as recited in claim 7, wherein said flag includes a bending of said key leveling tab.

9. A keyboard musical instrument, as recited in claim 1, wherein said key leveling tab includes a rough surface for contacting said balance rail.

10. A keyboard musical instrument, as recited in claim 9, wherein said rough surface has roughness in the range from 320 to 800 grit sandpaper.

11. A keyboard musical instrument, as recited in claim 1, wherein said key leveling tab includes a plurality of layers.

12. A keyboard musical instrument, as recited in claim 11, wherein each said layer includes a layer of paper and a layer of glue.

13. A keyboard musical instrument, as recited in claim 12, wherein said layer of glue includes paper glue.

14. A keyboard musical instrument, as recited in claim 11, further comprising a bottom layer, wherein said bottom layer includes at least one from the group consisting of a rough surface and a tacky surface.

15. A keyboard musical instrument, as recited in claim 11, wherein said bottom layer includes sandpaper.

16. A keyboard musical instrument, as recited in claim 1, wherein said key leveling tab includes a single layer material.

17. A keyboard musical instrument, as recited in claim 16, wherein said single layer material includes at least one from the group consisting of a polymer material, wood, wood fiber, and fiberglass.

18. A keyboard musical instrument, comprising a key, a balance rail and a key leveling tab, wherein said key leveling tab is permanently mounted on said balance rail, wherein said key leveling tab includes a slot, wherein said key leveling tab includes a side for contacting said balance rail, wherein said side for contacting said balance rail includes at least one from the group consisting of a rough surface and a tacky surface.

19. A keyboard musical instrument, as recited in claim 18, wherein said key leveling tab has at least one from the group consisting of a wedge shape and a staircase shape.

20. A method of regulating height of a key on a keyboard musical instrument, comprising:

a. providing a keyboard musical instrument having a key, a balance rail, and a wedge shaped key leveling tab, wherein said wedge shaped key leveling tab is mounted on said balance rail under said key;

b. providing an external adjusting tool and connecting said external adjusting tool to said key leveling tab;

c. using said external adjusting tool to adjust position of said key leveling tab on said balance rail to adjust height of said key to a desired height; and d. disconnecting said external adjusting tool from said key leveling tab.

21. A method as recited in claim 20, further comprising a keyframe, wherein said connecting said external adjusting tool includes temporarily inserting said external adjusting tool between said key and said key frame, wherein said adjusting position includes at least one from the group consisting of pulling on said external adjusting tool and pushing on said external adjusting tool.

22. A method as recited in claim 21, wherein said key leveling tab includes a hole wherein said external adjusting tool includes a hook, wherein using said external adjusting tool includes placing said hook into said hole.

23. A method as recited in claim 20, wherein said key has a front portion, wherein adjusting position of said key leveling tab adjusts height of said front portion.

24. A method as recited in claim 20, further comprising a second key and a second wedge shaped key leveling tab, wherein said second wedge shaped key leveling tab is mounted on said balance rail under said second key, further comprising connecting said external adjusting tool to said second key leveling tab to adjust position of said second key leveling tab on said balance rail to adjust height of said second key.

25. A keyboard musical instrument, as recited in claim 1, wherein said key leveling tab is non-resonating.

26. A keyboard musical instrument, as recited in claim 1, wherein said first portion has a wedge shape.

* * * * *